United States Patent [19]

Schroll

[11] Patent Number: 5,076,801

[45] Date of Patent: Dec. 31, 1991

[54] ELECTRONIC COMPONENT INCLUDING INSULATION DISPLACEMENT INTERCONNECT MEANS

[75] Inventor: Ross E. Schroll, East Rochester, N.Y.

[73] Assignee: Xerox Corporation, Stamford, Conn.

[21] Appl. No.: 544,117

[22] Filed: Jun. 22, 1990

[51] Int. Cl.[5] ..... H01R 4/24

[52] U.S. Cl. ..... 439/404; 439/620; 439/488

[58] Field of Search ..... 439/540, 541, 567, 620, 439/912, 482, 395–407, 488, 490; 315/156, 157

[56] References Cited

U.S. PATENT DOCUMENTS

| | | | |
|---|---|---|---|
| 3,421,013 | 1/1969 | Angelari | 315/156 |
| 3,798,587 | 3/1974 | Ellis, Jr. et al. . | |
| 4,068,912 | 1/1978 | Hudson, Jr. et al. . | |
| 4,295,704 | 10/1981 | Narozny et al. . | |
| 4,362,347 | 12/1982 | Berglund et al. | 439/912 |
| 4,579,414 | 4/1986 | Caveney et al. . | |
| 4,588,854 | 5/1986 | Bailey et al. | 439/567 |
| 4,618,204 | 10/1986 | Saligny . | |
| 4,629,946 | 12/1986 | Amano et al. | 315/156 |
| 4,668,039 | 5/1987 | Marzili . | |
| 4,669,801 | 6/1987 | Worth . | |
| 4,691,977 | 9/1987 | Marzili et al. . | |
| 4,697,862 | 10/1987 | Hasircoglu . | |
| 4,776,706 | 10/1988 | Loiterman et al. | 439/620 |
| 4,822,299 | 4/1989 | Riger, Jr. | 439/402 |
| 4,846,720 | 7/1989 | Song | 439/620 |
| 4,861,943 | 8/1989 | Yarmark | 439/567 |
| 4,952,169 | 8/1990 | Hayes, Sr. | 439/403 |

*Primary Examiner*—David L. Pirlot
*Attorney, Agent, or Firm*—Oliff & Berridge

[57] ABSTRACT

An electronic component is disclosed wherein the electronic component includes an insulation displacement connector for electrically connecting the electronic component to at least one external wire by displacing insulation from and contacting a conductor of the external wire. The insulation displacement connector can include a plurality of contacts electrically connected to the electronic component at one end thereof, and structure for displacing insulation from an external wire so that the external wire is placed in electrical communication with the conductive contact member at another end thereof. By locating the plurality of contact members closely adjacent each other, the insulation displacement connector can be engaged with a ribbon cable having a plurality of external wires, so that each contact is selectively engaged with an individual external wire in the ribbon cable. A cover can be provided which is removably engageable over the ribbon cable to lock the ribbon cable to the insulation displacement connector with the external wires of the ribbon cable electrically connected to the insulation displacement connector. Attachment structure can be provided on, for example, a lower surface of a hollow body to which the electronic component is mounted, for attaching the hollow body, and thus the electrical component, to any surface.

27 Claims, 3 Drawing Sheets

ELECTRONIC COMPONENT INCLUDING INSULATION DISPLACEMENT INTERCONNECT MEANS

BACKGROUND OF THE INVENTION

1. Field of the Invention

The present invention involves electronic components, and in particular electronic components having integral insulation displacement interconnect structure which permits the electronic component to be incorporated into a larger, or host, system.

2. Description of Related Art

Current electronic components, and in particular electronic sensor components, include pin-and-socket connectors for attachment to a larger, or host, system which incorporates the electronic component therein. These pin-and-socket interconnect systems typically require soldering to the wiring of the host device to ensure a secure electrical connection thereto. Thus, it is not easy to replace these electronic components due to the requirement of melting the solder joint, which also tends to damage the wiring of the host device and, possibly, adjacent circuitry if, for example, the electronic component is attached to a circuit board. Additionally, since electronic components which include pin-and-socket connectors are typically physically secured to the host device using the pin-and-socket connection, the flexibility in placement of the electronic component in the host device is limited. For example, typically the electronic component includes a number of pins which are inserted into and soldered to electrically conductive sockets in a printed circuit board of the host device. This insertion and soldering electrically and physically attaches the component to the host device. The flexibility in placement of the component in the host device is limited since it must be attached to the circuit board at a particular location thereof (i.e., the socket location). If the host device is redesigned so that its physical arrangement changes or additional components are required, the entire circuit board may have to be reconfigured so that the previously existing electronic components are in the proper location relative to the host device or to accommodate the additional electronic components. This problem is particularly apparent when the electronic component is a sensor component which must be located relative to particular elements of the host device to be sensed.

U.S. Pat. No. 4,579,414 to Caveney et al discloses a flat cable connector for attachment to the terminal end or midportion of a multi-wire ribbon cable. A connector base, or body, includes a plurality of Insulation Displacement Connectors (IDCs), each of which attaches at one end thereof to a wire in the ribbon cable. Opposite ends of the IDCs terminate at a socket, or pin receiving portion, for attachment to an electrical component. A cover overlies the ribbon cable and secures the wires thereof to the IDCs.

U.S. Pat. No. 4,669,801 to Worth discloses another connector for attachment to a multi-wire ribbon cable. A plurality of IDCs are provided in a base for electrical attachment to the ribbon cable. A metal latch secures a cover to the base and a special strain relief strap is fixed to the cover to hold the cable in position against strain forces. The connector attaches the ribbon cable to electrical components using pin and socket connections.

U.S. Pat. Nos. 4,668,039 to Marzili and 4,691,977 to Marzili et al disclose connectors for attachment to terminal ends or mid-portions of multi-wire ribbon cables. IDCs electrically connect to individual wires in the ribbon cable. The connector attaches to electrical components with pin and socket connections.

U.S. Pat. No. 4,068,912 to Hudson, Jr. et al discloses a method and apparatus for terminating multi-conductor flat flexible cables. The connector assembly includes a clamp member which initially engages a multi-conductor ribbon cable and drives the conductors to the desired spacing, which conforms to the fixed spacing of a plurality of IDCs in a connector housing member. After attachment of the ribbon cable to the IDCs, the connector can be attached to electrical components using pin and socket connections.

U.S. Pat. No. 4,697,862 to Hariscoglu discloses a connector which attaches to a ribbon cable having coaxial wires therein. The connector attaches to electrical components using pin and socket connections.

U.S. Pat. No. 4,295,704 to Narozny et al discloses a connector for attachment to a multi-wire ribbon cable via IDCs. The connector attaches to electrical components with pin and socket connections. Probeable passages are provided in the connector body or cover so that the electrical connection between the IDCs and the wires can be inspected.

U.S. Pat. No. 4,618,204 to Saligny discloses a connection device for telecommunication lines. Two separate casing parts are provided for the simultaneous connection and disconnection of a plurality of electrical line wires. A slot is provided into which a test element can be inserted in order to test the connection between wires.

U.S. Pat. No. 3,798,587 to Ellis, Jr. et al discloses a connector for attaching individually provided wires to one another using double-sided IDCs.

OBJECTS AND SUMMARY OF THE INVENTION

It is an object of the present invention to provide electronic components which are easily incorporated into and removable from host devices.

It is another object of the present invention to provide an electronic component having electrical interconnect structure associated therewith which is low in cost and highly reliable.

It is another object to the present invention to provide an electronic component which can be located in any number of positions relative to a host device regardless of the existing physical and electrical architecture of the host device.

It is another object of the present invention to provide an electronic component having interconnect structure associated therewith wherein the electrical connection of the component to the host device can be inspected.

It is a further object of the present invention to provide an electronic sensor component having all of the above recited advantages.

To achieve the foregoing and other objects, and to overcome the shortcomings discussed above, an electronic component is disclosed wherein the electronic component includes insulation displacement connector means for electrically connecting the electronic component to at least one external wire by displacing insulation from and contacting the conductors of the external wire. The insulation displacement connector means can include a plurality of contacts electrically connected to the electronic component at one end thereof, and displacement means for displacing insulation from an external wire so that the external wire is placed in electrical communication with the conductive contact member at another end thereof. By locating the plurality of contact members closely adjacent each other, the insulation displacement connector means can be engaged with a ribbon cable having a plurality of external wires, so that each contact is selectively engaged with an individual external wire in the ribbon cable. A cover can be provided which is removably engageable over the ribbon cable to lock the ribbon cable to the insulation displacement connector means with the external wires of the ribbon cable electrically connected to the insulation displacement connector means. Attachment means can be provided on, for example, a lower surface of a hollow body to which the electronic component is mounted for attaching the hollow body, and thus the electronic component, to any surface. Thus, an electronic component can be incorporated into an existing system easily and without reconfiguration or replacement of circuit boards in the system. Additionally, defective or worn electronic components can be removed from a system without soldering or removal of circuit boards to which the component is attached.

BRIEF DESCRIPTION OF THE DRAWINGS

The invention will be described in detail with reference to the following drawings in which like reference numerals refer to like elements and wherein.

DETAILED DESCRIPTION OF THE PREFERRED EMBODIMENT

Figure 1:
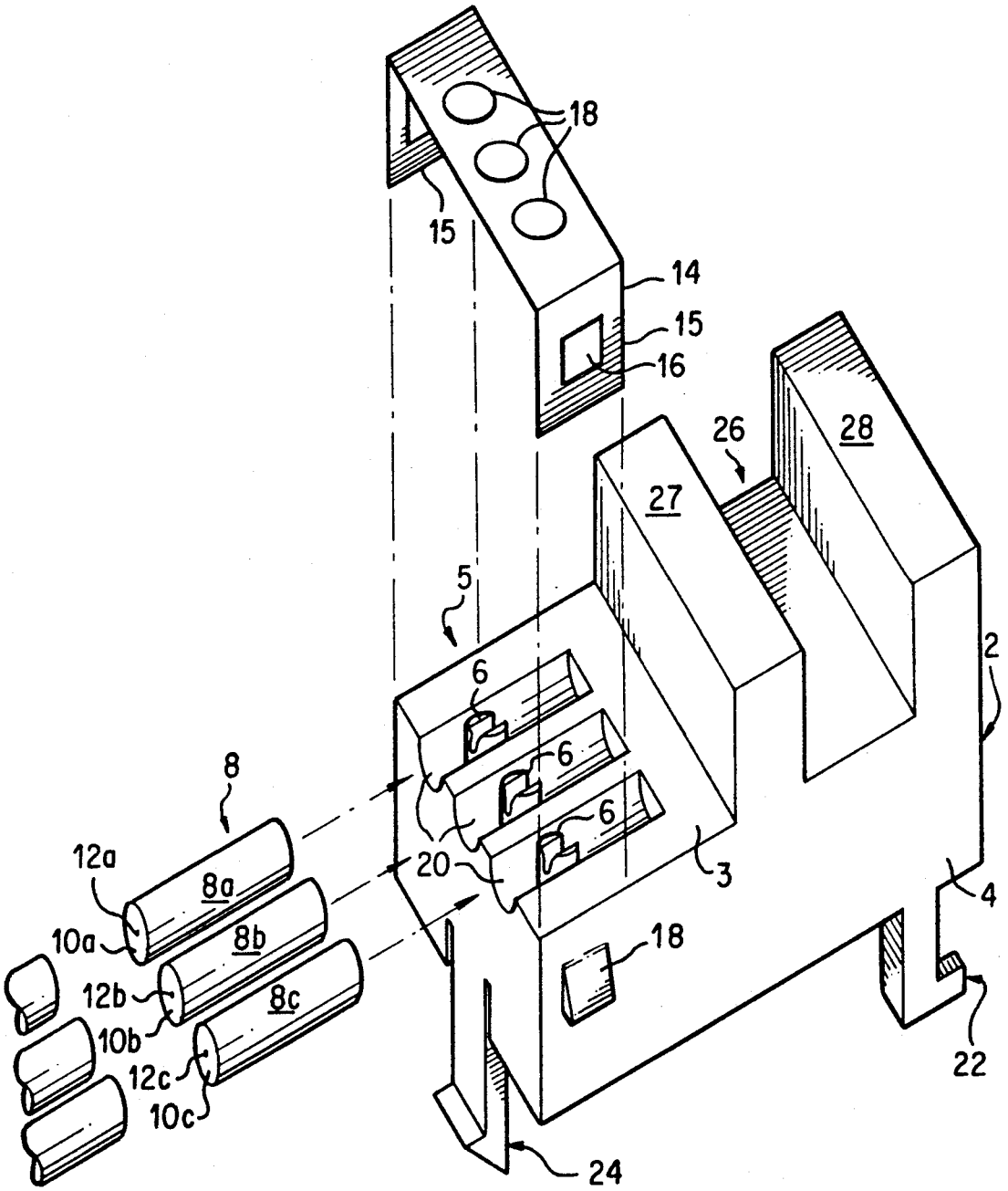
FIG. 1 is an exploded perspective view of an apparatus including an electronic component and insulation displacement connector means.

FIG. 1 is an exploded view of an apparatus 2 incorporating an electronic component according to the present invention. Apparatus 2 includes a hollow body 4 which is preferably molded from, for example, plastic. The electronic component associated with apparatus 2 can be located outside of hollow body 4, entirely within hollow body 4 (as in the preferred embodiment electronic sensor component to be described below) or located partially within hollow body 4. Structure other than hollow body 4 can be provided as long as the apparatus includes an electronic component and an insulation displacement connector means, to be described below. The hollow body 4 illustrated in FIG. 1 includes a first surface 3 through which insulation displacement connector means 5 extends. Insulation displacement connector means 5 can be any type of connector which displaces insulation from an outer surface of a wire and electrically contacts the conductors of the wire, preferably without severing the conductors. The insulation displacement connector means 5 shown in FIG. 1 is attachable to a ribbon cable 8 which includes three separate wires 8*a*, 8*b* and 8*c*. Each wire 8*a–c* includes conductors 12*a–c* surrounded by insulation 10*a–c*, respectively. When attached to insulation displacement connector means 5, the insulation 10*a–c* of each wire 8*a–c* is severed and conductors 12*a–c* are electrically attached to the electronic component. While ribbon cable 8 is shown to have three wires 8*a–c*, it is understood that insulation displacement means 5 can be attached to ribbon cables having more, or less wires, as well as to one or more separate wires or to coaxial wires. With the abovedescribed structure, electronic components can be easily incorporated into preexisting systems without reconfiguring circuit boards in the system because the component includes its own insulation displacement connector means for attachment to a wire or ribbon cable.

Apparatus 2 can also include attachment means such as, for example, legs 22, 24 for attaching apparatus 2 to a surface. In the illustrated embodiment, two rigid legs 22 are provided, one on either side of apparatus 2 (only one leg 22 is shown), each of which extends downwardly from a lower surface of hollow body 4 and includes a foot 22F extending outwardly therefrom. A resilient leg 24 is also provided which extends downwardly from a lower surface of hollow body 4 and includes a tooth 24T at an end thereof. Apparatus 2 can be removably attached to a surface, such as, for example, a circuit board, a panel or any other surface in the host device, by inserting rigid legs 22 into an aperture in the mounting surface and snapping resilient leg 24 into another aperture in the mounting surface. The present invention is not limited to the specific attachment means comprising legs 22, 24 shown, but it is understood that any type of structure which removably or permanently attaches apparatus to a surface can be used. For example, pressure sensitive adhesive, screws and the like can be used as attachment means. Additionally, attachment means can be associated with any part of apparatus 2, and not necessarily with a lower surface of hollow body 4. Since the attachment means preferably does not electrically connect apparatus 2 to the host device, unlike pin-and-socket connectors which physically mount and electrically connect the associated electronic component to the host device, the present invention greatly increases the flexibility with which electronic components can be incorporated into larger systems.

Figure 2:
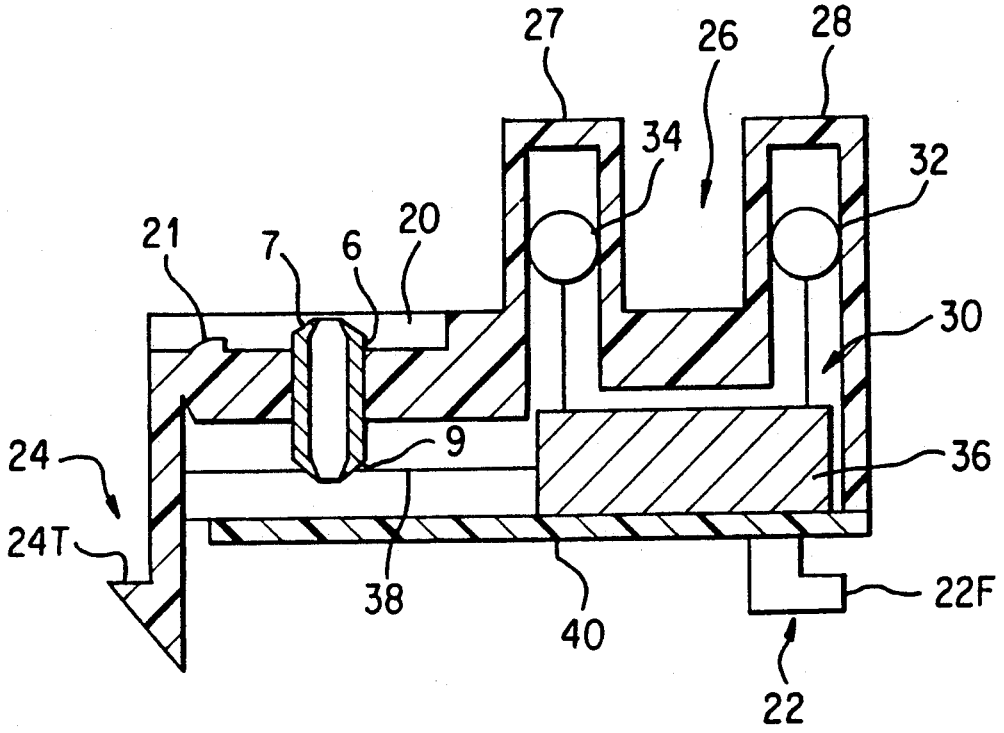
FIG. 2 is a cross-sectional view along a plane passing through the center of the apparatus along the longitudinal axis thereof.

FIGS. 1 and 2 illustrate one exemplitive form of the present invention wherein the electronic component incorporated into apparatus 2 is an electronic sensor component 30 having sensor means including an emitter 32 for emitting light and a detector 34 for detecting light emitted by emitter 32. Emitter 32 and detector 34 are electrically connected to signal producing means 36 for producing a signal based upon the detection of detector 34. Signal producing means can be, for example, an amplifier, a printed wire board, a thin film circuit (such as a custom silicon chip), a thick film circuit, or the like, which outputs a signal based on the detection or lack of detection of light by detector 34. In the illustrated embodiment, hollow body 4 includes a channel 26 located between hollow walls 27 and 28. Emitter 32 is located within hollow wall 28 and detector 34 is located within hollow wall 27. By making hollow body 4 from a plastic material which is infrared transmissive, electronic sensor 30 can detect the presence or absence of an object within channel 26 based upon the lack of detection or the detection, respectively, of light by detector 34. Devices including a light sensor wherein an emitter and detector are located on either side of a channel are also known as "channel sensors". These channel sensors can be used, for example, to monitor the rotation of a motor by inserting a round disk having a plurality of equally spaced openings on its peripheral surface and attached at its axis to the shaft of the motor in channel 26 so that the peripheral edge of the disc alternately blocks the passage of light therethrough or allows the passage of light through the holes therein. In this manner, the speed of rotation or number of revolutions of the motor can be monitored. It is understood that channel sensors can be used for a variety of other applications which require the detection of the presence or absence of some element at a particular location (i.e., inside channel 26). If a material which is not infrared transmissive is used to form hollow body 4, apertures or windows are formed in the walls 27,28 of channel 26 so that light emitted by emitter 32 can be detected by detector 34.

Electronic sensor component 30 is electrically connected to insulation displacement connector means 5 via one or more wires 38. Insulation displacement connector means 5 can be any type of connector which is capable of attaching electronic component 30 to a host device by displacing insulation from and contacting the conductors of one or more wires which are attached to the host device. In the illustrated embodiment, insulation displacement connector means 5 includes three conductive contact members 6. As illustrated in FIG. 2, each conductive contact member 6 includes a first end 7 which is attachable to a wire 8 a-c of the host device and a second end 9 attached to a wire 38 of the signal generating means 36. The contact members 6 are located adjacent each other so that each contact member 6 selectively engages a corresponding one of external wires 8*a–c* of ribbon cable 8.

Figure 3:
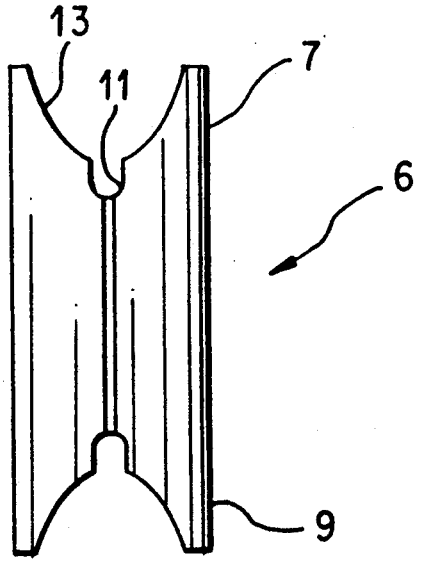
FIG. 3 is a side view of a double ended IDC contact which can be used with the present invention.
Figure 4:
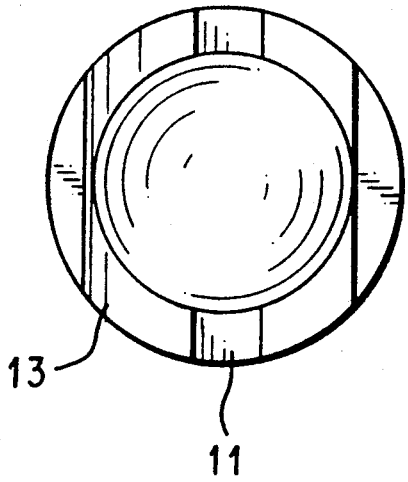
FIG. 4 is top view of the IDC contact of FIG. 3.
Figure 5:
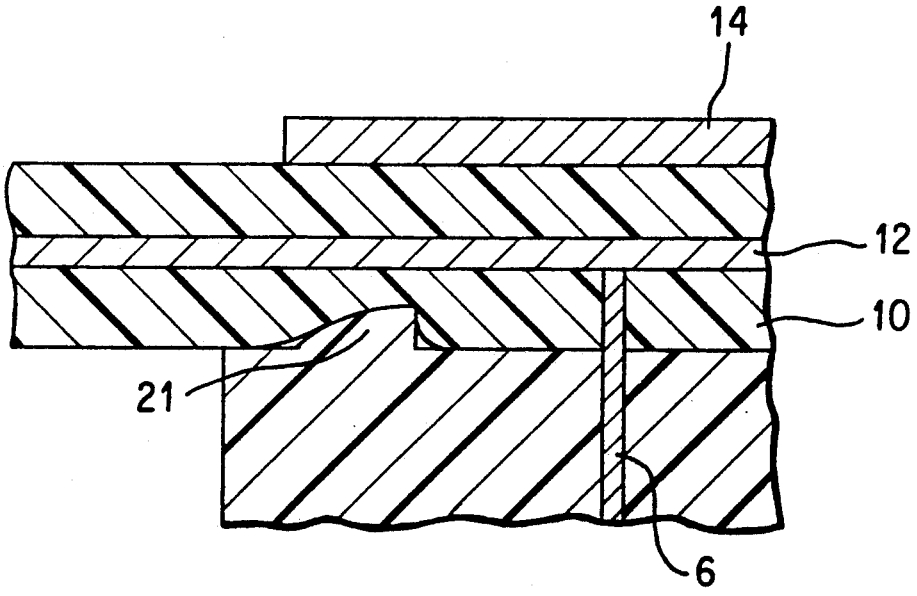
FIG. 5 is a sectional view of a strand of ribbon cable attached to the apparatus of the present invention.

One possible configuration for conductive contact member 6 is illustrated in FIGS. 3 and 4 and is made from a conductive, metallic material which is bent into the shape of a cylinder and has portions cut-out from its first and second ends 7, 9, respectively, to form displacement means for displacing insulation 10*a–c* from the conductors 12*a–c* of one of wires 8*a–c* so that the wire can be placed in electrical communication with conductive contact member 6. Although the contact member 6 illustrated in FIGS. 3 and 4 includes displacement means on both the first and second ends 7, 9 thereof, it is understood that displacement means only needs to be formed on the first end 7 of contact member 6 for displacement of insulation from and electrical communication with a wire from a host device. Second end 9 of each conductive contact member 6 can be soldered to wire 38 or, if a displacement means is provided at second end 9, it can be attached to wire 38 in a manner similar to the attachment of end 7 to one of the host device wires 8*a–c*. The displacement means is formed on one or both ends of conductive contact member 6 by removing portions of the material forming contact member 6 by, for example, cutting, to form cutting portion 13 and wire receiving portion 11. A variety of configurations for forming insulation displacement connector means are available and, since these configurations are well known in the art, no further explanation is necessary.

When an electronic component such as electronic sensor component 30 is located within hollow body 4, the second end 9 of each conductive contact member 6 is located and attached to sensor 30 inside of hollow body 4 and the first end 7 of contact member 6 extends through hollow body 4 and is located on an external surface 3 thereof. When such a configuration is employed, it is preferable to mold contact members 6 into hollow body 4. Three separate contact members 6 protrude through surface 3 of hollow body 4 in the embodiment shown in the drawings. Each contact member 6 is located in a recess 20 formed in surface 3. Each recess 20 serves to properly locate and align each wire 8*a–c* with a corresponding contact member 6 so that contact member 6 will properly displace insulation from and contact the appropriate conductors 12*a–c* of each wire 8*a–c*. A cover 14 can also be provided which is removably attached to hollow body 4. Cover 14 includes a pair of resilient arms 15 on opposite sides thereof, each arm having an aperture 16 therethrough for respectively engaging tabs 18 located on opposite sides of hollow body 4 so that cover 14 can snap onto hollow body and secure external wires 8*a–c* of ribbon cable 8 to the contact members 6 of insulation displacement connector means 5. End portions of resilient arms 15 can be outwardly flared to permit a tool to be easily placed thereunder for removing cover 14 from hollow body 4. Additionally, apertures 18 can be provided in cover 14 which permit a probe to be passed therethrough to contact first end 7 of each contact member 6 so that the connection of the conductor 12*a–c* of each wire 8*a–c* to contact 6 can be inspected. Additionally, as shown in FIG. 2, a tooth 21 can be provided in each recess 20, for contacting the insulation 10*a–c* of each wire 8*a–c* without contacting the conductor 12*a–c* thereof to prevent each wire 8*a–c* from being pulled out of its corresponding recess 20.

Thus, the present invention provides an electronic component which can be incorporated into larger systems easily and reliably. By avoiding the use of pin-and-socket connections, no soldering is required to attach or remove the component from a host device. The provision of insulation displacement connector means permits the electronic component to be electrically attached to other components such as, for example, logic boards, of a host device by using wires or ribbon cables and thus does not require circuit boards of the host device to be reconfigured. Additionally, by separating the structure which performs the electrical connecting and the physical mounting functions, the placement of the electronic component within the host device is not tied to the electrical configuration of the host device.

While the present invention is described with reference to electronic sensor components, this particular embodiment is intended to be illustrative, not limiting. For example, the present invention is applicable to any type of electronic means for receiving signals from at least one wire, performing a function such as, for example, sensing, calculating, emitting, receiving, outputting, inputting and the like, and outputting an output signal to at least another wire. The terminology "electronic component" as used in the present description is meant to apply to any device which uses electrons. For example, the present invention is also applicable to wrap spring clutches, solenoids, small D.C. motors, and the like. Additionally, while insulation displacement connector means 5 is shown to be attachable to a ribbon cable 8, the present invention can also be used to attach an electronic component to separate wires. Various modifications may be made without departing from the spirit and scope of the invention as defined in the appended claims.

What is claimed is:

1. Apparatus comprising:

a hollow body;

a sensor mounted to said hollow body, said sensor having an emitter for emitting light, a detector for detecting light emitted by the emitter, and signal producing means for producing a signal based upon the detection of the detector; and insulation displacement connector means, electrically connected to said sensor, for electrically connecting said sensor to at least one external wire by displacing insulation from and contacting a conductor of the at least one external wire, wherein said hollow body includes a channel having opposed walls, said emitter and said detector each being located behind a different one of said opposed walls, respectively, so that said sensor is capable of detecting the existence of an object in said channel.

2. The apparatus according to claim 1, wherein said signal producing means is an amplifier electrically connected to said emitter, said detector and said insulation displacement connector means.

3. The apparatus according to claim 1, wherein said signal producing means is a printed wire board electrically connected to said emitter, said detector and said insulation displacement connector means.

4. The apparatus according to claim 1, wherein said hollow body is made from an infrared transmissive material.

5. The apparatus according to claim 1, wherein said insulation displacement connector means is molded into said hollow body.

6. The apparatus according to claim 1, wherein said insulation displacement connector means includes at least one conductive contact member having first and second ends, said first end having displacement means for displacing insulation from an external wire so that a conductor of the external wire is placed in electrical communication with said conductive contact member, and said second end being electrically connected to said sensor.

7. The apparatus according to claim 6, wherein said second end of said at least one conductive contact member also includes displacement means for displacing insulation from a wire attached to said sensor.

8. The apparatus according to claim 6, wherein said hollow body includes a first surface, said first end of said at least one conductive contact member protruding through said first surface for engaging the external wire, and further comprising a cover, said cover being attachable to said hollow body over said first surface for maintaining the external wire electrically connected to said at least one conductive contact member.

9. The apparatus according to claim 8, wherein said cover includes an aperture for passage of a probe therethrough so that the connection of the conductor of the external wire to said contact can be checked.

10. The apparatus according to claim 8, wherein said cover is removably attachable to said hollow body.

11. The apparatus according to claim 10, wherein said cover includes a pair of resilient arms on opposite sides thereof, said arms each having an aperture therethrough for respectively engaging tabs located on opposite sides of said hollow body so that said cover snaps onto said hollow body to cover said first surface.

12. The apparatus according to claim 8, wherein said first surface includes at least one recess, corresponding in number and location to said at least one conductive contact member, said first end of said at least one contact member being located in said recess.

13. The apparatus according to claim 12, wherein said at least one recess includes a tooth for engaging insulation of the external wire without contacting the conductors of the external wire to prevent the external wire from being pulled out of said recess.

14. The apparatus according to claim 6 wherein a plurality of conductive contact members are provided, each being attachable to a separate external wire.

15. The apparatus according to claim 1, wherein said insulation displacement connector means is capable of displacing insulation from and contacting a plurality of external wires.

16. The apparatus according to claim 15, wherein said insulation displacement connector means is capable of displacing insulation from and contacting a plurality of external wires in a ribbon cable.

17. The apparatus according to claim 1, further comprising attachment means, connected to said hollow body, for attaching said hollow body to a surface.

18. The apparatus according to claim 17, wherein said attachment means is for removably attaching said hollow body to a surface.

19. The apparatus according to claim 17, wherein said attachment means includes at least one leg for engaging a hole in said surface.

20. The apparatus according to claim 19, wherein said attachment means includes first and second rigid legs extending downwardly from a lower surface of said hollow body and having feet which extend outwardly therefrom, and a third, resilient leg extending downwardly from said lower surface of said hollow body and including a tooth at an end thereof, whereby said first and second rigid legs can be inserted into an aperture in the surface, and said third, resilient leg can be snapped into another aperture in the surface to attach said hollow body to the surface.

21. The apparatus according to claim 1, wherein said sensor is mounted at least partially inside of said hollow body.

22. The apparatus according to claim 21, wherein said sensor is mounted entirely inside of said hollow body.

23. The apparatus according to claim 14, wherein said plurality of conductive contact members are located closely adjacent each other so that said plurality of conductive contact members are each selectively engageable with an individual external wire in a ribbon cable.

24. The apparatus according to claim 23, further comprising attachment means, connected to said hollow body, for attaching said hollow body to a surface.

25. The apparatus according to claim 24, wherein said attachment means is for removably attaching said hollow body to a surface.

26. The apparatus according to claim 24, wherein said attachment means includes at least one leg for engaging a hole in the surface.

27. The apparatus according to claim 26, wherein said attachment means includes first and second rigid legs extending downwardly from a lower surface thereof and having feet which extend outwardly therefrom, and a third, resilient leg extending downwardly from said lower surface and including a tooth at an end thereof, whereby said first and second rigid legs can be inserted into an aperture in the surface, and said third, resilient leg can be snapped into another aperture in the surface to attach said hollow body to the surface.

* * * * *